United States Patent [19]

Nowak

[11] Patent Number: 4,708,396

[45] Date of Patent: Nov. 24, 1987

[54] COAL SHAVER

[75] Inventor: Dieter Nowak, Herne, Fed. Rep. of Germany

[73] Assignee: Klöckner-Becorit GmbH, Castrop-Rauxel, Fed. Rep. of Germany

[21] Appl. No.: 861,298

[22] Filed: May 9, 1986

[30] Foreign Application Priority Data

May 11, 1985 [DE] Fed. Rep. of Germany ..... 3517064

[51] Int. Cl.[4] ..... F21C 27/44

[52] U.S. Cl. ..... 299/34; 299/80

[58] Field of Search ..... 299/34, 32, 80, 36

[56] References Cited

U.S. PATENT DOCUMENTS

| | | | |
|---|---|---|---|
| 3,445,138 | 5/1969 | Lobbe et al. | 299/34 |
| 3,779,603 | 12/1973 | Baz | 299/34 |
| 3,877,752 | 4/1975 | Hauschopp et al. | 299/80 X |
| 4,119,347 | 10/1978 | Merten et al. | 299/34 |
| 4,189,187 | 2/1980 | Rassmann et al. | 299/34 |
| 4,199,194 | 4/1980 | Steinkuhl et al. | 299/80 X |
| 4,275,927 | 6/1981 | Merten et al. | 299/80 X |

FOREIGN PATENT DOCUMENTS

| | | | |
|---|---|---|---|
| 1300889 | 8/1969 | Fed. Rep. of Germany . | |
| 2309820 | 8/1974 | Fed. Rep. of Germany | 299/34 |
| 2819082 | 11/1979 | Fed. Rep. of Germany . | |
| 2250535 | 12/1980 | Fed. Rep. of Germany . | |
| 1943016 | 8/1982 | Fed. Rep. of Germany . | |
| 2500680 | 12/1982 | Fed. Rep. of Germany . | |
| 981429 | 1/1965 | United Kingdom | 299/34 |

*Primary Examiner*—Stephen J. Novosad
*Assistant Examiner*—David J. Bagnell
*Attorney, Agent, or Firm*—Watson, Cole, Grindle & Watson

[57] ABSTRACT

A coal shaver which includes cutter fronts also includes shearing blades and bottom blades at both ends of the coal shaver, for extraction work in both shaver cutting directions; the coal shaver having shearing blades attached to the shaver body and bottom blades attached to the shanks, which are arranged to be adjustable and locked in guides at the shaver body. The coal shaver is designed such that the shearing blades are attached to the cutter strips, which are arranged to be pivoted at the shaver body around its longitudinal axis, and the bottom blades are attached to the shanks, arranged to pivot around the swivel bolt, which is attached across the mining direction, and is guided such that it is movable in the longitudinal direction in the coulisse guides at the shaver body.

5 Claims, 3 Drawing Figures

COAL SHAVER

BACKGROUND OF THE INVENTION

1. Field of the Invention

The present invention relates to a coal shaver with cutter fronts, comprised of shearing blades and bottom blades at both ends of the coal shaver, for extraction work in both shaver cutting directions, whereby the shearing blades are attached to the shaver body and the bottom blades are attached to the shanks, which are arranged to be adjustable and lockable in the guides, provided for at the shaver body.

2. The Prior Art

In one coal shaver known in the art (German patent specifications Nos. 13 00 889, 19 43 016, 22 50 535 and 25 00 680) the shearing blades are graduated one after the other from bottom to top at both ends, respectively, of the coal shaver. The shearing blades form a ramp-like ascending plane on which the loosened coal to be found in the shaver gap is raised to the upper edge of the side profile of the conveyer so that the coal can be loaded into the conveyer. Each main group of chisels has a bottom blade set in front, which is attached to a circular shaped sliding segment. The sliding segments are arranged to pivot in the corresponding circularly shaped guide, located below the main groups of chisels of the shaver body so that the cutting depth of the bottom blade can be adjusted.

In this known coal shaver, the bottom blade can be set at different angles to the cutting direction, depending on the altitude level of the coal shaver, so that the the resulting release and thrust force, acting on the bottom blade, results in a lateral force on the shank and thus results in a flexural moment on the curved shank. This is sometimes the reason for fractures observed in the bottom blade shank.

Another shaver known in the art (German specification No. 28 19 082) has flapper-type tool holders with shearing blades, which are arranged to pivot on axes, rotating in the longitudinal direction of the flapper-type coal holders; the blades are attached to the holders, which are on both sides of the shaver body. With respect to the shearing blades, working in the same direction of shaver travel, the bottom blades are set so far back that in every direction of shaver travel the bottom blade, which is put into operating position, is at the rear end of the plane near the shearing blades, which are idle in the rear.

SUMMARY OF THE INVENTION

The purpose of the present invention is to provide a coal shaver of the aforementioned type in which the angle of the bottom blade, independent of the set height of the bottom blade, remains constant in the cutting direction, and is thus independent of the height level of the bottom blade.

According to the invention the shearing blades are attached to the cutter elements, which are arranged to pivot at the shaver body around its longitudinal axis, and the bottom blades are attached to shanks which are arranged to pivot around swivel bolts, which are attached across the extraction direction and guided such that they can be shifted in coulisse guides at the shaver body in a longitudinal direction.

This construction results in a coal shaver of the aforementioned type in which the stress on the bottom blade is constant at each altitude level; and specifically because the angle of the bottom blade remains constant in the cutting direction, independent of its height level.

In a preferred embodiment of the present invention the shearing blades on the cutter strip are graduated such that the respective upper shearing blades are opposed to the respective lower shearing blades and are set back with respect to the shaver cutting direction. At the same time, this results in all of the shearing blades acting like a loading ramp and raising the loosened coal so high that the coal falls over the side walls of the conveyer into the conveyer.

The longitudinal axes of the cutter strips are preferably sloped opposite the shaver cutting direction.

In another embodiment of the invention the swivel bolt for the bottom blade can be positioned in the sliding block; and the sliding block can be guided in a coulisse guide. Thus the bottom blade is guided not directly but rather via the sliding block. This results in the shank of the bottom blade and the bottom blade itself being correspondingly treated with care.

It is advantageous to have the bottom blades in the longitudinal direction of the shank infinitely adjusted and locked. This can be accomplished by infinitely adjusting and locking the bottom blades via spindles.

In the coal shaver designed according to the invention the bottom blades and the shearing blades in the shaver cutting direction are in the foremost position. This results in an especially short shaver stall. In addition to this, the pivoting angle of the bottom blade is advantageous as a result of the elevated swivel bolt.

The invention will be better understood by reference to the attached drawings, taken in conjunction with the following discussion.

DETAILED DESCRIPTION OF THE PREFERRED EMBODIMENT

Figure 1:
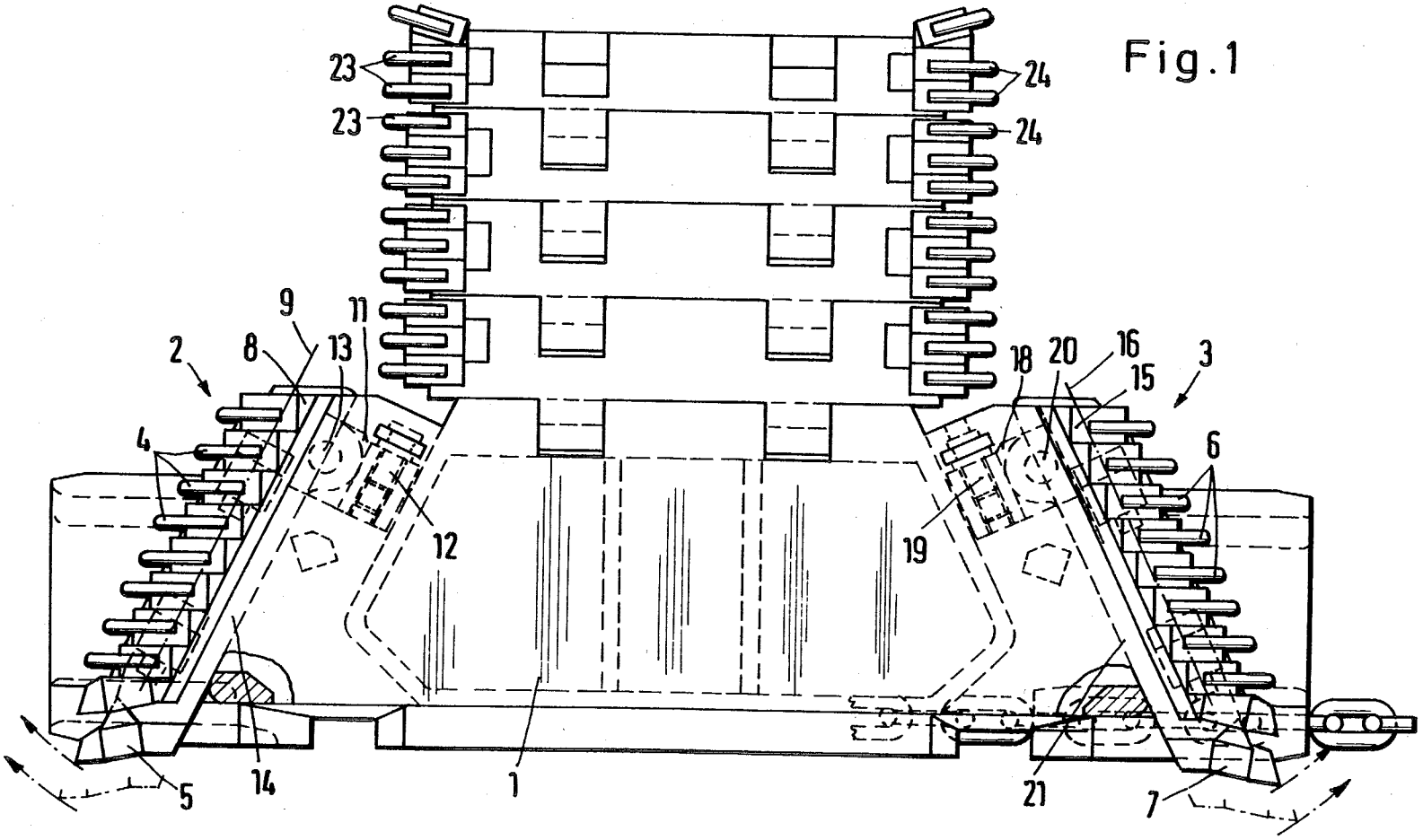
FIG. 1 is an elevational view of the inventive coal shaver as seen from the front side thereof.
Figure 2:
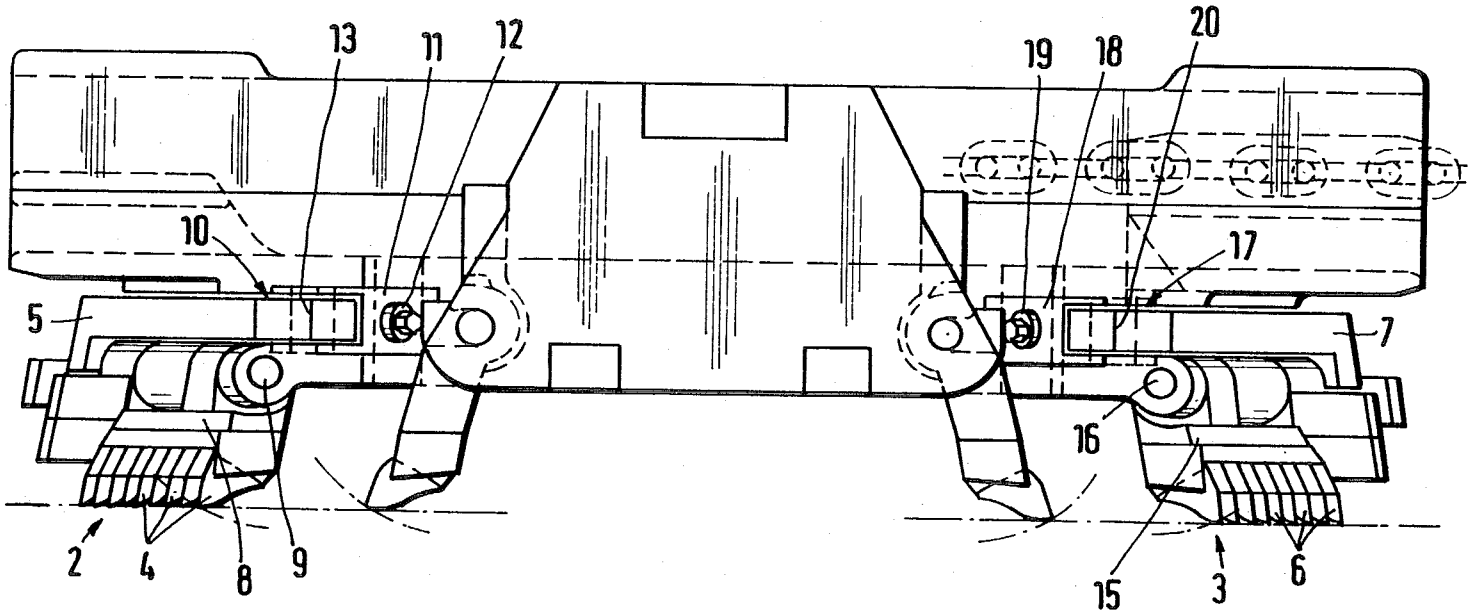
FIG. 2 is a plan view of the coal shaver shown in FIG. 1.
Figure 3:
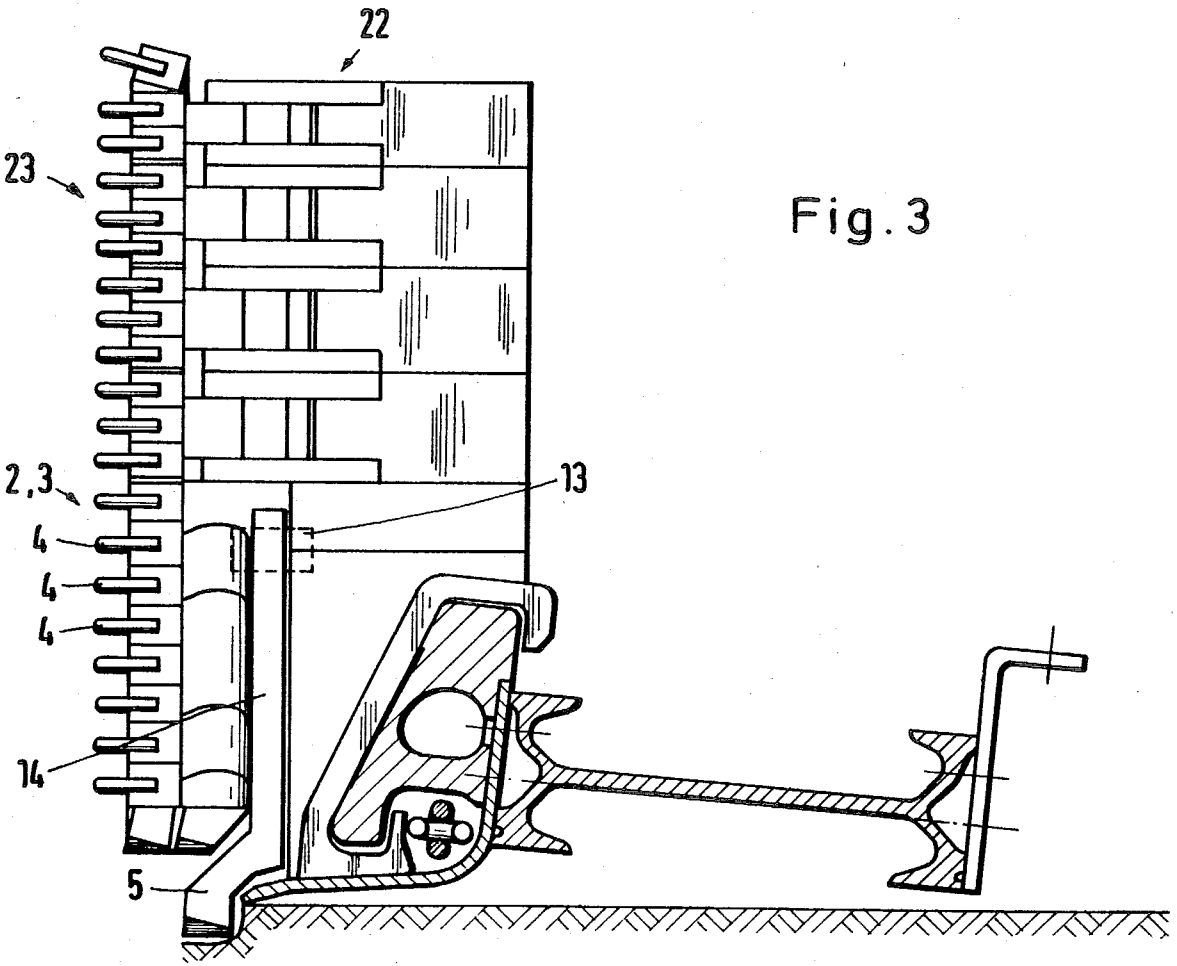
FIG. 3 is an end view of the coal shaver, the shaver guide and conveyer being shown in section.

The coal shaver shown in FIGS. 1–3 has a shaver or elongated carriage body 1, with cutter elements or fronts 2, 3 mounted to its front side (the side that faces the side wall of the coal deposit) near its respective opposite ends. The cutter front 2 is comprised of shearing blades 4 and a bottom blade 5. Just like the cutter front 2, the cutter front 3, includes shearing blades 6 and a bottom blade 7. The shearing blades 4 of the cutter front 2, shown on the left in FIG. 1, are graduated backwards from bottom to top and arranged on a cutter strip 8, which is arranged to pivot around a swivel axis 9, rotating in its longitudinal direction. The swivel axis 9 extends upwardly toward an imaginary vertical line which extends through the midpoint of the shaver body 1.

Shaver body 1 provides a guide channel 10 in which a sliding block 11 is arranged so as to be slidingly movable along the guide channel due to its cooperation with a spindle 12. The sliding block 11 has a swivel bolt 13 at which the shank 14 of the bottom blade 5 is arranged to pivot.

The conditions are similar on the right side of FIG. 1. The shearing blades 6 are graduated backwards from bottom to top on a cutter strip 15 and thus form a type of ramp for the loosened coal. The cutter strip 15 is arranged to pivot around its longitudinal axis 16. In the guide 17, a sliding block 18 is arranged to be infinitely adjusted via a spindle 19. In the sliding block 18 there is a swivel bolt 20 in which the shank 21 of the bottom blade 7 is arranged to pivot.

The shaver body 1 utilizes shaver components 22 with shearing blades 23 and 24 for both shaver cutting directions.

I claim:

1. A coal shaver apparatus for shaving pieces of coal from a side wall of a coal deposit, said coal shaver apparatus comprising an elongated carriage body which is adapted for back and forth movement parallel to the side wall of a coal deposit, said elongated carriage body having a front side facing the side wall of the coal deposit, a bottom side, a top side and opposite ends, said elongated carriage body also including straight guide channels which respectively extend from the top side to the bottom side near the opposite ends thereof, a mounting means attached to said elongated carriage body near the upper end of each said guide channel so as to be movable along the associated guide channel, a pair of elongated cutter elements respectively attached to the front side of said elongated carriage body near the opposite ends thereof, each of said pair of cutter elements being mounted to said elongated carriage so as to be pivotable about an axis line which extends upwardly, each of said pair of cutter elements including vertically spaced apart shearing blades for contacting the side wall of the coal deposit, and a pair of bottom blade elements which are attached to said elongated carriage body and are associated with a respectively guide channel, each bottom blade element including a straight shank which extends within a guide channel and has an upper end and a lower end, the upper end of each shank being attached to a respective mounting means, and a bottom blade attached to the lower end of each shank so as to contact the coal deposit below the shearing blades of an associated cutter element.

2. A coal shaver apparatus as defined in claim 1, wherein each mounting means comprises a sliding block and spindle along which the sliding block can move, said spindle extending in the same direction as its associated guide channel.

3. A coal shaver apparatus as defined in claim 1, wherein the axis line around which each of said elongated cutter elements is pivotable extends upwardly toward an imaginary vertical line which extends through the midpoint of said elongated carriage body.

4. A coal shaver apparatus as defined in claim 3, wherein each guide channel extends upwardly along a line which extends towards said imaginary vertical line which extends through the midpoint of said elongated carriage body.

5. A coal shaver apparatus as defined in claim 3, wherein the shearing blades of each elongated cutter element have similar sizes and shapes and are positioned one above another along a line which is parallel to the axis line around which the elongated cutter element pivots.

* * * * *